US005160461A

United States Patent [19]

Burrows

[11] Patent Number: 5,160,461

[45] Date of Patent: * Nov. 3, 1992

[54] CHILLED BEVERAGE SYSTEM

[75] Inventor: Bruce D. Burrows, Valencia, Calif.

[73] Assignee: Ebtech, Inc., Columbus, Ohio

[ * ] Notice: The portion of the term of this patent subsequent to Dec. 10, 2008 has been disclaimed.

[21] Appl. No.: 831,803

[22] Filed: Feb. 3, 1992

Related U.S. Application Data

[63] Continuation-in-part of Ser. No. 653,055, Feb. 11, 1991, Pat. No. 5,085,810, which is a continuation-in-part of Ser. No. 562,244, Aug. 3, 1990, Pat. No. 5,071,595.

[51] Int. Cl.[5] ..... B01F 3/04; B01F 5/10

[52] U.S. Cl. ..... 261/140.1; 261/91; 261/DIG. 7; 366/315

[58] Field of Search ..... 261/91, DIG. 7, 140.1; 366/315, 149

[56] References Cited

U.S. PATENT DOCUMENTS

| | | | |
|---|---|---|---|
| 490,525 | 1/1893 | Werner | 366/280 |
| 602,938 | 4/1898 | Gaines | 366/280 |
| 1,854,754 | 4/1932 | Morris | 261/DIG. 7 |
| 2,391,003 | 12/1945 | Bowman | 261/DIG. 7 |
| 3,088,716 | 5/1963 | Stott | 366/315 |
| 3,243,128 | 3/1966 | Tight | 366/149 |
| 3,298,618 | 1/1967 | Talpey | 366/315 |
| 3,400,551 | 9/1968 | Booth et al. | 261/DIG. 7 |
| 5,071,595 | 12/1991 | Burrows | 261/91 |
| 5,073,312 | 12/1991 | Burrows | 261/140.1 |
| 5,085,810 | 2/1992 | Burrows | 261/140.1 |

*Primary Examiner*—Tim Miles

*Attorney, Agent, or Firm*—Kelly, Bauersfeld & Lowry

[57] ABSTRACT

An improved system is provided for thoroughly chilling a beverage such as water flowing into a refrigerated reservoir. The system includes an injector nozzle disposed generally at an upper end of the reservoir, together with a dispense valve for drawing the beverage in chilled form from a lower end of the reservoir. A vertically elongated and rotatably driven impeller shaft is mounted within the reservoir and carries a spaced plurality of vaneless impeller disks for causing the beverage flowing downwardly through the reservoir to undergo a plurality of directional changes in a radially outward direction for improved heat transfer with a chiller coil wrapped about the reservoir. This improved heat transfer provides for efficient beverage chilling prior to dispensing. The system is particularly useful in dispensing chilled water, juices, and soft drink beverages.

7 Claims, 3 Drawing Sheets

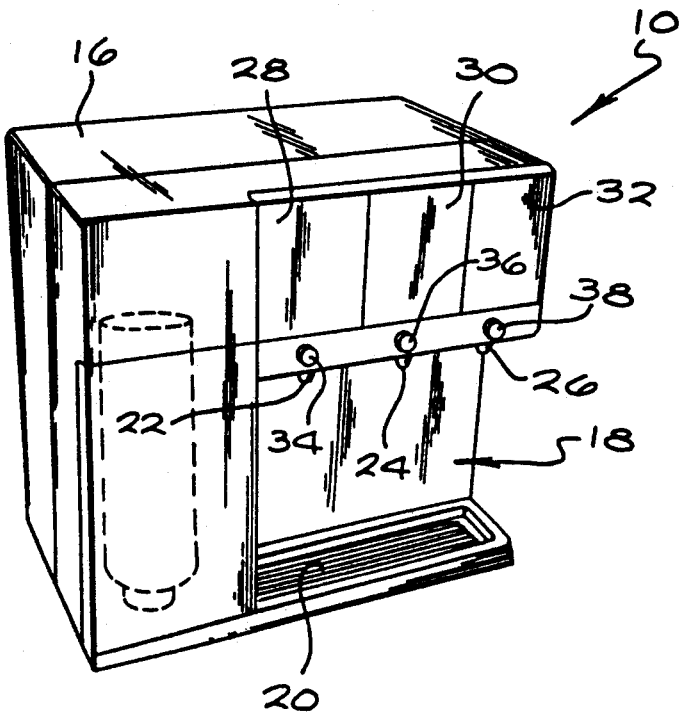
FIG. 1
FIG. 2
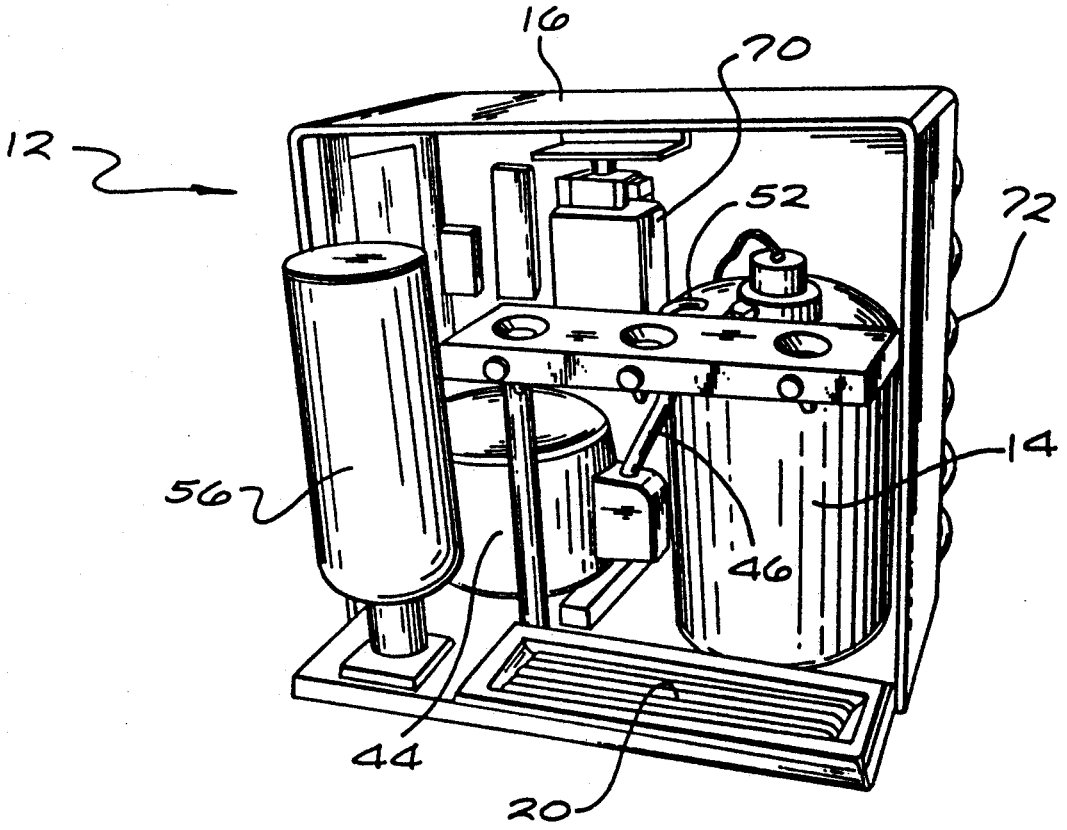

CHILLED BEVERAGE SYSTEM

This is a continuation-in-part of copending U.S. Ser. No. 653,055, filed Feb. 11, 1991, now U.S. Pat. No. 5,085,810, which is in turn a continuation-in-part of copending U.S. Ser. No. 562,244, filed Aug. 3, 1990, and now issued as U.S. Pat. No. 5,071,595.

BACKGROUND OF THE INVENTION

This invention relates generally to improvements in devices and systems for carbonating and chilling water or other beverages, particularly with respect to dispenser stations and/or vending machines and the like for use in mixing and dispensing chilled beverages which may be carbonated. More specifically, this invention relates to an improved system designed for more efficient gas-water mixing and more efficient chilling of the resultant beverage.

Carbonated water systems are generally known in the art for mixing a carbonating gas, such as carbon dioxide gas, with a fresh water supply to producing a highly pleasing and refreshing carbonated beverage which is often mixed in suitable proportion with a flavored syrup or the like. Such carbonator systems are often employed in soft drink dispenser stations and/or vending machines or the like and are adapted to dispense the carbonated soft drink beverage in individual servings, typically on the order of 6–8 ounce servings. In this form, the system typically includes a water reservoir adapted to receive fresh water from a tap water or similar source, with the reservoir being encased within surrounding cooling coils of a mechanical refrigeration unit such that the water within the reservoir is chilled to a desired low temperature. The carbonating gas is supplied to the reservoir at a regulated pressure for intermixing with the chilled water to produce the carbonated beverage. Injectors and/or stirring agitator devices are often employed to enhance gas-liquid intermixing. A dispenser valve is normally provided for dispensing the beverage from the reservoir, typically in coordinated operation with a refill valve such that a volume of water dispensed from the reservoir is concurrently replaced by a fresh volume from the water source.

Although carbonated water and chilled beverage systems of the above-described general type have achieved relatively broad commercial use, a variety of problems and disadvantages are present. For example, to achieve adequate chilling of the water or other beverage within the reservoir, it has been necessary to construct and operate the refrigeration unit in a manner producing an annular ice block or ice ring within the reservoir at the periphery thereof. The presence of this ice ring effectively reduces the overall available volume of the water reservoir which, in an optimized system, is designed to be relatively compact to minimize power requirements of the refrigeration unit. Unfortunately, as a result, the residence time of a given water volume within the reservoir may be reduced such that achieving the desired low temperature level of the final beverage becomes difficult or impossible when several servings are dispensed at close time intervals. Moreover, a refill volume of water entering the reservoir may be subjected to a relatively direct and undesired flow path through the center of the ice ring between a reservoir inlet and dispensing outlet. Achieving the desired low temperature of the final beverage is further complicated by the fact that the chilled water is often mixed upon dispensing with a proportional quantity of a selected flavor syrup which, if not separately refrigerated, acts to warm the already inadequately chilled water.

There exists, therefore, a significant need for further improvements in carbonated water and other chilled beverage systems for use in preparing and dispensing beverages, wherein the residence time of each refill water volume within a refrigerated reservoir is increased to achieve substantially improved chilling and/or concurrent gas mixing despite dispensing of multiple servings in rapid succession. The present invention fulfills these needs and provides further related advantages.

SUMMARY OF THE INVENTION

In accordance with the invention, an improved beverage system is provided for use in the efficient production of chilled water or other chilled beverage which may be carbonated. The system includes an improved mixing impeller arrangement within a refrigerated refillable reservoir for forcing the beverage to flow along a tortuous, direction-changing path during passage from an inlet to a dispensing outlet. As a result, the beverage encounters improved heat transfer with surrounding cooling coils of a refrigeration unit for chilling purposes. In addition, improved intermixing for carbonation purposes is also provided when a carbonating gas is present.

In the preferred form, the reservoir includes an injector nozzle at one end thereof for the introduction of the selected beverage, such as water. The cooling coils of a mechanical refrigeration unit are wrapped about the reservoir to chill the beverage therein. A dispensing valve permits selective drawing of the chilled beverage from the reservoir via a dispensing outlet disposed generally at an opposite end of the reservoir from the injector nozzle. In a typical arrangement, the injector nozzle is located at an upper end of the reservoir, and the dispensing outlet is located at a lower end of the reservoir. The improved mixing impeller is mounted generally centrally within the reservoir and includes a plurality of spaced impeller disks for redirecting beverage flow passing generally downwardly through the reservoir.

More specifically, the mixing impeller comprises an elongated impeller shaft extending generally vertically through a central region of the reservoir. The shaft is adapted to be rotatably driven about its own axis, with one preferred drive means including a suitable drive motor mounted outside the reservoir and operably connected to the shaft via a hermetically sealed magnetic coupling or the like. The impeller disks are mounted on the shaft for rotation therewith and preferably comprise vaneless disks to permit rotational driving thereof with minimal power consumption. These disks each redirect the general downflow direction of the beverage to a radially outward direction, with the resultant multiple directional flow changes providing significantly improved heat transfer chilling efficiency.

In an alternative preferred form of the invention, one of the impeller disks constitutes a vaned disk located on the impeller shaft in a position to be rotatably driven on an intermittent basis by a beverage stream injected into the reservoir. In this form, the vaned disk is preferably mounted at or near an upper end of the impeller shaft at a location slightly above the reservoir liquid level, with the remaining impeller disks being submerged and having a vaneless construction.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a front perspective view of a soft drink dispenser station including an improved chilled beverage system embodying the novel feature of the invention;

FIG. 2 is a front perspective view of the dispenser station of FIG. 1, with frontal portions of station housing structures removed to expose components thereof;

DETAILED DESCRIPTION OF THE PREFERRED EMBODIMENT

Figure 3:
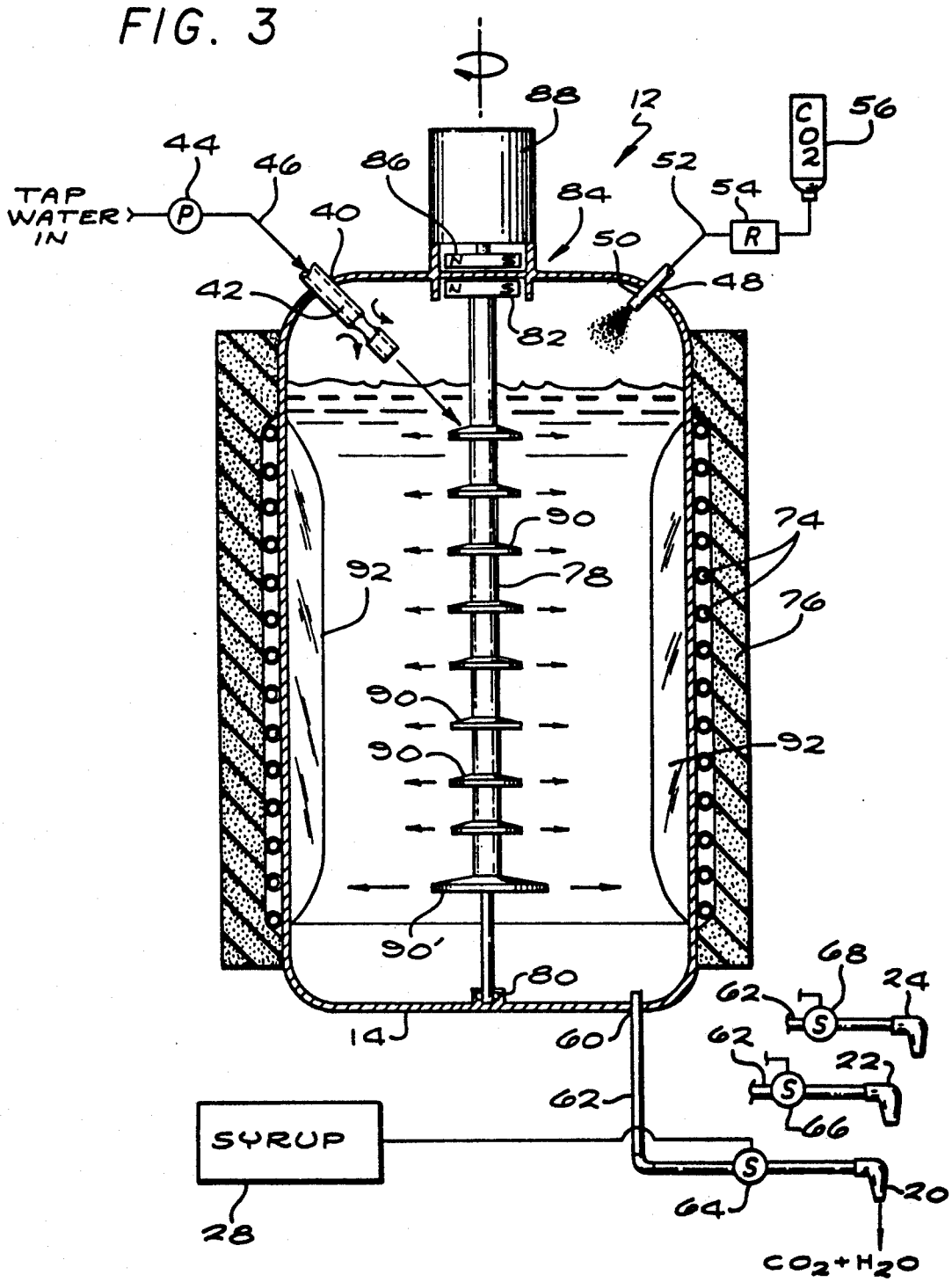
FIG. 3 is an enlarged and somewhat schematic vertical sectional view depicting the construction and operation of a refrigerated and refillable reservoir forming a primary feature of the invention.

As shown in the exemplary drawings, an improved chilled beverage system is provided for use in a soft drink dispenser station or the like, as referred to generally by the reference numeral 10 in FIGS. 1 and 2. The beverage system 12, shown in best detail in FIG. 3, includes an improved yet relatively simple impeller arrangement which provides significant improvements in water chilling efficiency, in addition to improved intermixing with a carbonating gas if desired.

The chilled beverage system of the present invention is particularly designed for use with beverage dispenser stations, vending machines, etc., of a type wherein a chilled beverage such as carbonated or uncarbonated water or other beverage in a chilled state is drawn off or dispensed in individual servings, typically by dispensing the beverage into a cup (not shown) of an approximate 8–12 ounce capacity. Each time an individual serving is dispensed, a reservoir 14 forming an integral portion of the system 12 is refilled with a fresh volume of water to be chilled and/or carbonated in preparation for subsequent dispensing. By providing improved thermal efficiency for better chilling in combination with improved gas-liquid mixing, the present invention enables the system 12 to employ a smaller volume reservoir 14 with reduced refrigeration energy consumption. Moreover, when the the beverage is chilled water for subsequent mixing with a flavor syrup or the like, the present invention beneficially provides an optimally chilled final beverage without requiring separate syrup refrigeration. The overall costs of the dispenser station 10 in terms of equipment and operating costs are thus reduced.

As shown generally in FIGS. 1 and 2, the illustrative dispenser station 10 includes a housing 16 which may be sized and shaped for a convenient and compact countertop installation. The exemplary housing 16 defines a forwardly open receptacle 18 having a shelf 20 for receiving a drinking cup (not shown) or the like in a filling position disposed immediately below any one of three separate dispensing nozzles 22, 24 and 26. These nozzles 22, 24 and 26 are respectively associated with a corresponding number of syrup containers 28, 30 and 32 (FIG. 1) adapted for removable mounting into the station housing 16. In addition, the nozzles 20, 22 and 24 are further associated with individual dispense actuators such as the illustrative dispense buttons 34, 36 and 38. While three dispense nozzles and related components are shown in the accompanying drawings, it will be understood that the present invention is applicable to any system having at least one dispense nozzle, and adapted to receive and chill a liquid beverage for subsequent dispensing.

As shown in FIG. 2, the reservoir 14 comprises a relatively compact tank adapted for installation into the interior of the station housing 16. The reservoir includes an upper water inlet 40 (FIG. 3) having a suitable injector nozzle 42 mounted therein, with a pump 44 (FIG. 2) or other suitable regulatory device being mounted within the housing 16 and connected to the water inlet 40 via a conduit 46. As is known in the art, the pump or device 44 functions to regulate the flow of water from a suitable tap or bottled water source to the reservoir.

The water inlet 40 is shown generally at the upper end of the reservoir 14 in a position adjacent to a gas inlet 48 having a suitable gas nozzle 50 mounted therein. As is known in the art, the nozzle 50 supplies the carbonating gas into the interior of the reservoir for intermixing with the water therein. In a typical system, the nozzle 50 is connected via a conduit 52 and pressure regulator 54 to a cartridge 56 containing a supply of carbon dioxide gas under pressure. The regulator 54 maintains a gas volume 58 within the reservoir 14 at a substantially constant pressure level, and the cartridge 56 may be conveniently adapted for easy replacement installation within the station housing 16. Alternately, the gas nozzle 50 can introduce the gas into the reservoir interior at any convenient location.

The carbonator system 12 further includes a dispensing outlet 60 positioned to open into the reservoir 14 at a position generally opposite the water and gas nozzles. The dispensing outlet 60 is coupled via an appropriate parallel flow network of conduits 62 (FIG. 3) to mixing and dispensing valves 64, 66 and 68 associated respectively with the dispensing nozzles 20, 22 and 24. These dispensing valves have a conventional construction known in the art for selective opening in response to depression of the buttons 34, 36 and 38 (FIG. 1) to draw the carbonated water from the reservoir 14, and to mix the carbonated water with a proportional quantity of flavor syrup from the containers 28, 30 and 32.

A conventional refrigeration unit is additionally provided for chilling the carbonated water within the reservoir 14. As shown in FIG. 2, the refrigeration unit includes an appropriate mechanical compressor 70 and related condenser coils 72 for supplying refrigerant to cooling coils 74 wrapped spirally about the reservoir 14 (FIG. 3). An insulation blanket 76 is normally wrapped in turn about the coils 74 to minimize thermal losses.

In accordance with the primary aspect of the invention, the improved impeller arrangement includes a vertically elongated impeller shaft 78 mounted at a generally centered position within the reservoir 14. A lower end of this shaft is seated within a bearing seat 80 at a lower end of the reservoir. An upper end of the impeller shaft carries a driven component 82 of a magnetic drive coupling 84, the drive component 86 of which is disposed outside the reservoir and is rotatably driven by a small drive motor 88. Accordingly, the impeller shaft 78 is driven by the magnetic coupling 84 for rotation about the vertically oriented shaft axis, while maintaining the coupling components in hermetically sealed relation.

A plurality of impeller disks 90 are mounted along the length of the impeller shaft 78 in vertically spaced relation to each other. These impeller disks 90 are rotatably driven with the impeller shaft and function to pump the water in a radially outward direction toward the periphery of the reservoir 14, and thus into closer proximity with the cooling coils 74 for improved heat transfer therewith. The cooperative effect of the multiple impeller disks 90 provides a multitude of directional flow changes to the water, with a corresponding significant increase in heat transfer for chilling, and associated improved gas intermixing. Moreover, the radially outward water flows tend to prevent formation of and/or otherwise minimize the size of any annular ice ring 92 at the reservoir periphery, while correspondingly improving overall heat transfer for chilling by disrupting any cold fluid boundary layer alongside the ice ring.

In the preferred form, for minimum power consumption, the impeller disks 90 are vaneless. This permits the disks to be rotated with minimal torque and with use of a relatively small drive motor 88. If desired, the lowermost disk 90' may be formed with a comparatively enlarged diameter size. Moreover, as shown, the water injector 42 desirably includes a venturi construction to entrain gas with the incoming water stream for better carbonation.

Figure 4:
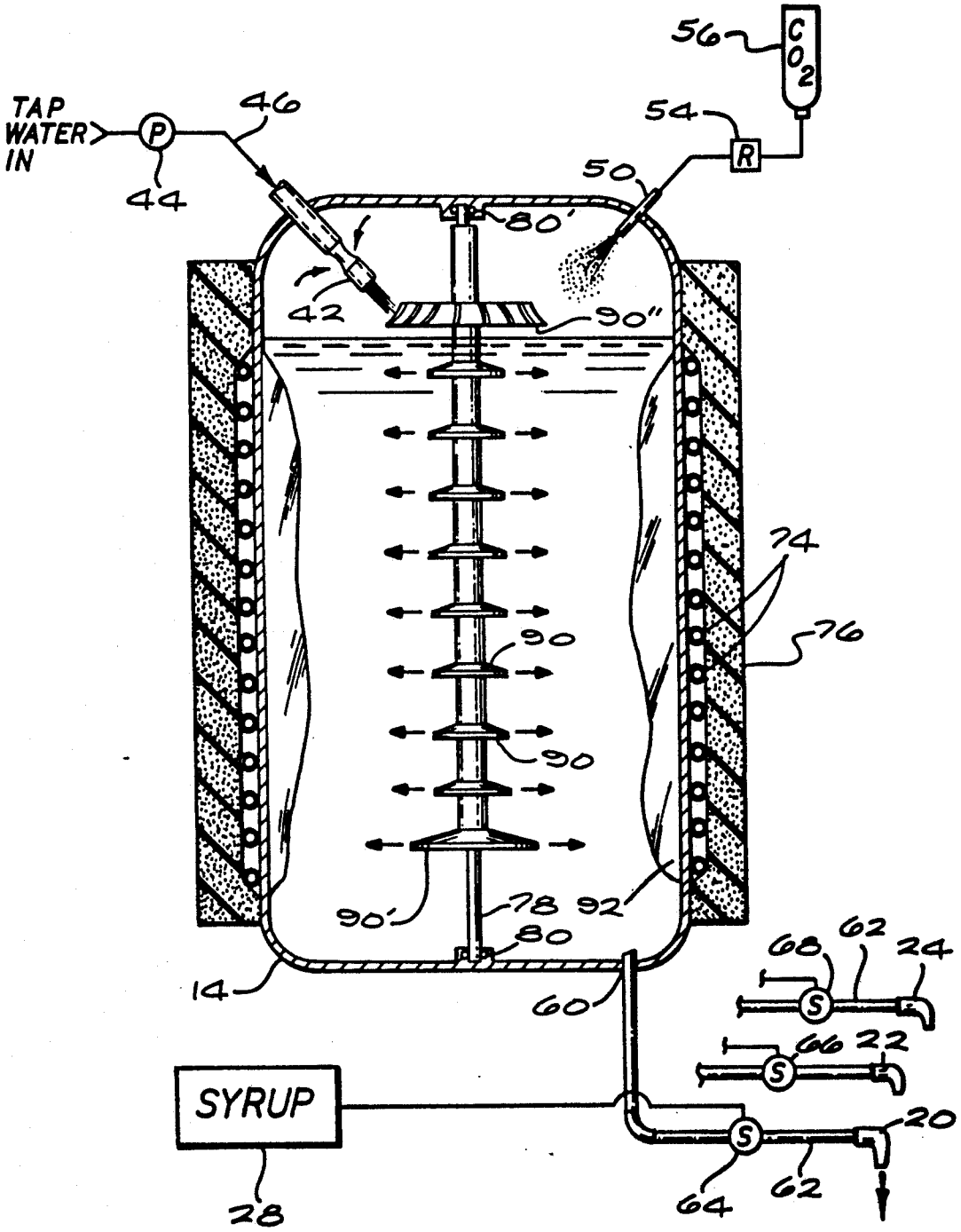
FIG. 4 is an enlarged and somewhat schematic vertical sectional view similar to FIG. 3 but illustrating one alternative preferred form of the invention.

FIG. 4 illustrates an alternative preferred form of the invention, wherein components corresponding with those shown and described in FIG. 3 are identified by common reference numerals. The embodiment of FIG. 4 differs by adaptation of the impeller shaft 78 for intermittent water-driven rotation within the reservoir 14, thereby permitting elimination of the impeller shaft drive motor and related shaft coupling structures. Moreover, FIG. 4 also eliminates the energy consumption associated with the shaft drive motor.

More particularly, as viewed in FIG. 4, the upper end of the impeller shaft 78 is rotatably supported within the reservoir 14 by a simple bearing 80'. The uppermost impeller disk 90'' on the shaft 78 is located substantially at or slightly above the reservoir liquid level and in a position to be impacted by a water jet or stream injected into the reservoir 14 through the injector nozzle 42. In this regard, the upper disk 90,, constitutes a vaned impeller disk and the injector nozzle 42 is preferably oriented to provide a water stream for tangentially contacting the disk 90''. Accordingly, each time water is injected into the reservoir, the water stream briefly drives the impeller shaft 78. The remaining disks 90 on the shaft 78 are submerged within the water and have a vaneless construction to provide the desired increased heat transfer for chilling purposes, with minimal torque requirements, as previously described.

The resultant beverage at the lower end of the reservoir (FIGS. 3 or 4) is thus chilled within maximum efficiency, and/or through the use of a relatively small capacity refrigeration unit. The final beverage at the dispense nozzles will have a desired low temperature, without requiring further refrigeration of any flavor syrup added thereto. Moreover, repeated and rapid servings can be accommodated while maintaining the reservoir water at the desired chilled state.

A variety of modifications and improvements to the water carbonator system of the present invention will be apparent to those persons skilled in the art. Accordingly, no limitations on the invention are intended by way of the foregoing description and accompanying drawings, except as set forth in the appended claims.

What is claimed is:

1. A chilled beverage system comprising:

a generally upright reservoir having upper and lower ends;

means for introducing a liquid beverage into said reservoir via an inlet disposed generally at one of said upper and lower ends of said reservoir;

an elongated impeller shaft extending generally centrally and vertically within said reservoir;

means for rotatably supporting said shaft for rotation about its own axis within said reservoir;

drive means for rotatably driving said shaft about its own axis;

a plurality of vaneless impeller disks carried on said shaft in vertically spaced relation for rotation therewith;

refrigeration means mounted at the periphery of said reservoir to chill the beverage within said reservoir sufficient to form an ice ring within the reservoir at the periphery thereof, said impeller disks having radially outer edges disposed in substantial spaced relation to said reservoir periphery; and dispensing outlet means disposed generally at the other of said upper and lower ends of said reservoir for drawing the chilled beverage from said reservoir, said disks upon rotation of said shaft each pumping the beverage in the vicinity thereof in a generally radially outward direction toward the periphery of said reservoir into direct contact with the ice ring for close heat exchange between the radially outwardly pumped beverage and the ice ring to chill the beverage, whereby said disks collectively pump beverage introduced into said reservoir into direct contact with the ice ring a plurality of times as such beverage travels between said upper and lower reservoir ends and before such beverage is drawn from said reservoir by said dispensing outlet means, and further whereby said disks collectively provide a plurality of radially outwardly directed beverage flows within said reservoir to minimize the size of the ice ring formed within said reservoir at a periphery thereof.

2. The chilled beverage system of claim 1 wherein said beverage introducing means comprises an injector nozzle.

3. The chilled beverage system of claim 1 wherein said drive means comprises a drive motor disposed outside said reservoir, and hermetically sealed coupling means for connecting said drive motor to said impeller means.

4. The chilled beverage system of claim 3 wherein said coupling comprises a magnetic coupling for drivingly connecting said motor with said impeller shaft.

5. The chilled beverage system of claim 1 wherein said beverage introducing means introduces the beverage into said reservoir generally at said upper end thereof.

6. The chilled beverage system of claim 1 wherein said dispensing outlet means includes a dispensing valve adapted for movement between open and closed positions.

7. The chilled beverage system of claim 1 wherein said drive means includes a vaned impeller disk on said impeller shaft and disposed in a position generally adjacent to said inlet and adapted to be driven rotatably by liquid beverage passing through said inlet into said reservoir, whereby said rotationally driven vaned impeller disk correspondingly rotatably drives said impeller shaft.

* * * * *